United States Patent [19]

Nicko et al.

[11] Patent Number: 4,761,933

[45] Date of Patent: Aug. 9, 1988

[54] ARRANGEMENT FOR CLOSING A RECEPTACLE FOR PHOTOGRAPHS AND NEGATIVES

[75] Inventors: Reinhard Nicko; Friedrich Meschenmoser, both of Munich; Karl-Heinz Sager, Ottobrunn; Rainer Türcke, Taufkirchen, all of Fed. Rep. of Germany

[73] Assignee: Agfa-Gevaert Aktiengesellschaft, Leverkusen, Fed. Rep. of Germany

[21] Appl. No.: 888,141

[22] Filed: Jul. 18, 1986

[30] Foreign Application Priority Data

Aug. 1, 1985 [DE] Fed. Rep. of Germany ..... 3527550

[51] Int. Cl.[4] ..... B65B 7/02; B65B 7/18

[52] U.S. Cl. ..... 53/374; 53/378; 53/381 R

[58] Field of Search ..... 53/371, 376, 374, 381 R, 53/382, 384, 266 A, 468, 378, 469

[56] References Cited

U.S. PATENT DOCUMENTS

| | | | |
|---|---|---|---|
| 3,015,926 | 1/1962 | Galambos | 53/266 A X |
| 3,143,838 | 8/1964 | Pouliart | 53/381 R X |
| 3,500,995 | 3/1970 | Forman . | |
| 3,807,121 | 4/1974 | Mundt et al. | 53/381 R X |
| 4,449,351 | 5/1984 | Henderson | 53/266 A X |
| 4,508,224 | 4/1985 | Weber et al. . | |
| 4,527,378 | 7/1985 | Russell | 53/381 R X |

*Primary Examiner*—Horace M. Culver
*Attorney, Agent, or Firm*—Peter K. Kontler

[57] ABSTRACT

A receptacle for packaging an order of photographs and negatives includes a base panel and a cover panel which define two pockets each of which has an openable and closable side. The base panel has a flap which extends beyond the openable and closable sides while the cover panel terminates at, and has an auxiliary tab adjacent to, the openable and closable sides. The flap is provided with a restraining tab which normally overlaps the auxiliary tab. The pockets have an open position in which the restraining tab is located between the auxiliary tab and the base panel, and a closed position in which the auxiliary tab is located between the restraining tab and the base panel. A device for closing the receptacle includes a slot designed to receive the region of the junction between the flap and the restraining tab, and a surface arranged to be contacted by the pockets. The slot and the surface have a relative orientation such that the flap is bent when the junction is received in the slot and the pockets contact the surface.

17 Claims, 4 Drawing Sheets

ARRANGEMENT FOR CLOSING A RECEPTACLE FOR PHOTOGRAPHS AND NEGATIVES

BACKGROUND OF THE INVENTION

The invention relates generally to a receptacle for film and/or photographs, and to a method of and an arrangement for manipulating the receptacle.

More particularly, the invention relates to a receptacle for developed film and/or photographs to be delivered to a customer, and to a method of and an arrangement for confining the film and/or photographs in the receptacle. The developed film is usually delivered to the customer in the form of strips each of which consists of a series of exposures. The film and/or photographs are normally confined in the receptacle as a stack.

The commonly-owned U.S. Pat. No. 4,508,224 discloses a receptacle for developed film and/or photographs. The receptacle consists of a base panel and a juxtaposed cover panel which together define two pockets for developed film and/or photographs. Each of the pockets has an open side for insertion of developed film and/or photographs therein and for removal of developed film and/or photographs therefrom, and the panels are secured to one another along the remaining sides of the pockets. The base panel has a flap which extends beyond the open sides of the pockets, and the connections between the panels terminate short of the open sides so that the cover panel has a free marginal portion or tab adjacent to such sides. This structure makes it possible to mechanically insert stacks of film strips and photographs into the pockets using a machine which is capable of lifting the tab of the cover panel.

A drawback of the known receptacle is that the relatively heavy stacks are not securely retained and can fall out if the receptacle is improperly handled. It is, of course, possible to fold the receptacle so that the pockets abut one another and to then apply an adhesive in the region of the flap. However, this makes opening of the receptacle irreversible, that is, the receptacle can no longer be closed after having been opened.

OBJECTS AND SUMMARY OF THE INVENTION

It is an object of the invention to provide a receptacle which may be reliably closed after having been opened.

Another object of the invention is to provide a receptacle which may be readily opened and closed.

An additional object of the invention is to provide a method which allows the receptacle to be reliably closed.

A further object of the invention is to provide a method which enables the receptacle to be closed in a relatively simple manner.

It is also an object of the invention to provide an arrangement capable of reliably closing the receptacle.

Yet another object of the invention is to provide an arrangement which allows the receptacle to be readily closed.

The preceding objects, as well as others which will become apparent as the description proceeds, are achieved by the invention.

One aspect of the invention resides in a receptacle for developed film and/or photographs, especially stacks of film and/or photographs. The film may be in the form of strips each of which consists of a series of exposures. The receptacle comprises a pair of juxtaposed panels defining at least one pocket having an openable and closable side. One of the panels (hereinafter "base panel" for convenience) has a flap extending beyond the openable and closable side. The other panel (hereinafter "cover panel" for convenience) terminates at, and includes a first tab adjacent to, the openable and closable side. The flap is provided with a second tab which normally overlaps the first tab.

The second tab (hereinafter "restraining tab" for convenience) is preferably relatively stiff, i.e., preferably has relatively good resistance to bending. The restraining tab may be bonded to the flap, and such bonding may be accomplished by means of an adhesive. The junction between the restraining tab and the flap is advantageously at least two millimeters wide and should allow the restraining tab and the flap to be displaced towards and away from one another.

The base panel and cover panel may define an additional pocket having an openable and closable side adjacent to the openable and closable side of the other pocket. The panels may be secured to one another along the remaining sides of the pockets, but the connections between the panels preferably terminate short of the openable and closable sides. The cover panel then has a free marginal portion which is adjacent to the openable and closable sides and may constitute the first tab (hereinafter "auxiliary tab" for convenience).

The receptacle of the invention is particularly well-suited for packaging an order of developed film and/or photographs to be delivered to a customer.

The auxiliary tab has a first position in which the openable and closable sides are open for insertion of developed film and/or photographs in, and for removal of developed film and photographs from, the pockets. The auxiliary tab further has a second position in which the openable and closable sides are closed. In the first position, at least part of the restraining tab is disposed between the auxiliary tab and the base panel while, in the second position, at least part of the auxiliary tab is disposed between the restraining tab and the base panel.

A method of manipulating the receptacle includes closing the openable and closable sides of the pockets subsequent to insertion of developed film and/or photographs therein. The closing operation comprises displacing the base panel and the restraining tab relative to one another so as to permit movement of the auxiliary tab by the restraining tab. The auxiliary tab is then moved towards the base panel, and the restraining tab is subsequently shifted towards the auxiliary tab to thereby confine the latter between the restraining tab and the base panel.

Preferably, the step of moving the auxiliary tab comprises bringing the latter into at least close proximity of the base panel, and the step of shifting the restraining tab comprises bringing the restraining tab into abutment with the auxiliary tab.

The closing operation is reversible and the pockets may again be opened by interchanging the positions of the tabs.

The invention further provides an arrangement for manipulating the receptacle, and the arrangement includes a unit for closing the openable and closable sides of the pockets subsequent to insertion of developed film and/or photographs therein.

According to one embodiment of the invention, the closing unit comprises first means defining a slot designed to receive the flap and guide the same for movement in a predetermined direction. The first means further defines a surface designed to support the pockets as the flap is conveyed along the slot, and the slot defines an angle of at least 35° with the surface. The closing unit further comprises second means for displacing the restraining tab so as to permit movement of the auxiliary tab by the restraining tab. The second means is arranged to displace the restraining tab in such a manner that the restraining tab and the supporting surface define an increasing angle, and preferably a progressively increasing angle, as the flap is conveyed along the slot. It is particularly favorable to design the second means so that the restraining tab is displaced to a position in which the restraining tab and the supporting surface define an angle in the range of 90°.

The slot and the supporting surface advantageously define an angle of substantially 45°.

The second means may include a tab displacing member having a guiding portion which guides the restraining tab as the flap is conveyed along the slot. This guiding portion may be inclined with reference to the direction of movement of the flap such that the lateral distance between the guiding portion and the supporting surface increases in such direction.

In accordance with another embodiment of the invention, the closing unit comprises means defining: (i) a slot designed to confine at least part of the flap; (ii) a deflecting element arranged to cause bending of the base panel upon introduction of the flap into the slot; and (iii) a surface arranged to be abutted by at least one of the pockets when the flap is confined in the slot and the base panel is bent at least 90°.

The slot may be bounded by a wall which is at least approximately perpendicular to the abutment surface, and the deflecting element may then be an extension of such wall.

The relatively stiff restraining tab provided on the flap of the base panel enables stacks of film and/or photographs to be reliably held in the receptacle when the auxiliary tab is disposed below the restraining tab, i.e., when the auxiliary tab is disposed between the restraining tab and the base panel. Due to the existing moment characteristics, the stacks are unable to slide out of the receptacle even when the openable and closable sides of the pockets face downwards. Thus, the stacks can generate only a small effective moment which is incapable of bending the restraining tab. In contrast, the closure constituted by the tabs may be opened by hand without difficulty. Furthermore, once the films and/or photographs have been studied, the closure may be readily locked once again without a loss in the closing force.

The restraining tab may be provided on the flap of the base panel with relatively little cost. It is possible for the restraining tab to be in the form of a discrete strip which is bonded to the flap, e.g., adhesively, and has a stiffness approximating that of the base panel. The restraining tab may also be formed by folding over a marginal portion of the base panel and then bonding, e.g., adhesively bonding, the fold to the main portion of the base panel over a width of at least two millimeters. A bond between the restraining tab and the base panel should not be dispensed with when the restraining tab is formed by a fold in the base panel. The bond insures that deflection of the fold towards its original position can occur only by bending the base panel and/or the fold. A restraining tab constituted by a fold which is not bonded to the base panel does not possess the requirements for reliable closing of the receptacle.

The arrangement of the invention, which is particularly well-adapted for performing the method of the invention, enables the positions of the restraining tab and auxiliary tab to be interchanged very quickly when the receptacle is to be closed. Thus, the auxiliary tab lies above the restraining tab while the receptacle is being filled, i.e., the restraining tab is disposed between the auxiliary tab and the base panel during filling. However, once the receptacle has been filled, the auxiliary tab must be transferred to a position below the restraining tab in order to close the receptacle. The arrangement of the invention allows this transfer to be accomplished rapidly.

The novel features which are considered as characteristic of the invention are set forth in particular in the appended claims. The improved receptacle and arrangement, however, both as to their construction and their mode of operation, together with additional features and advantages thereof, will be best understood from a perusal of the following detailed description of certain specific embodiments with reference to the accompanying drawings.

Figure 3:
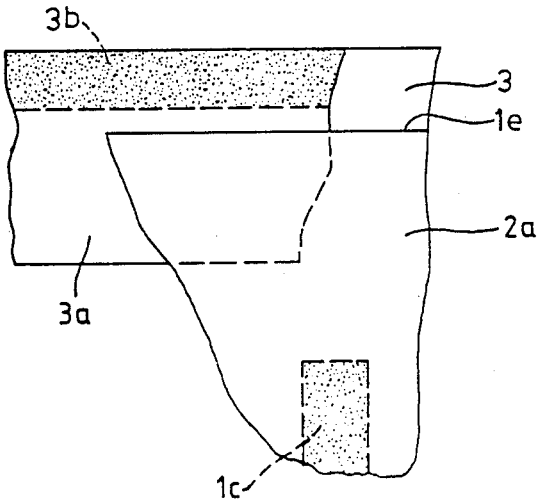
FIG. 3 illustrates a detail of the receptacle of FIG. 1 in an enlarged plan view.
Figure 4:
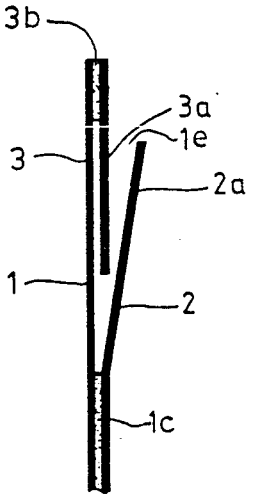
FIG. 4 is a side view of the detail of FIG. 3.
Figure 6:
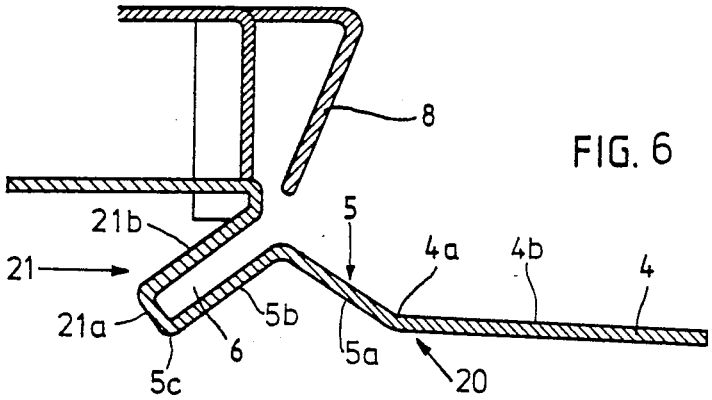
FIG. 6 is a sectional view of the unit of FIG. 5 as seen in the direction of the arrows VI—VI of FIG. 5.
Figure 5:
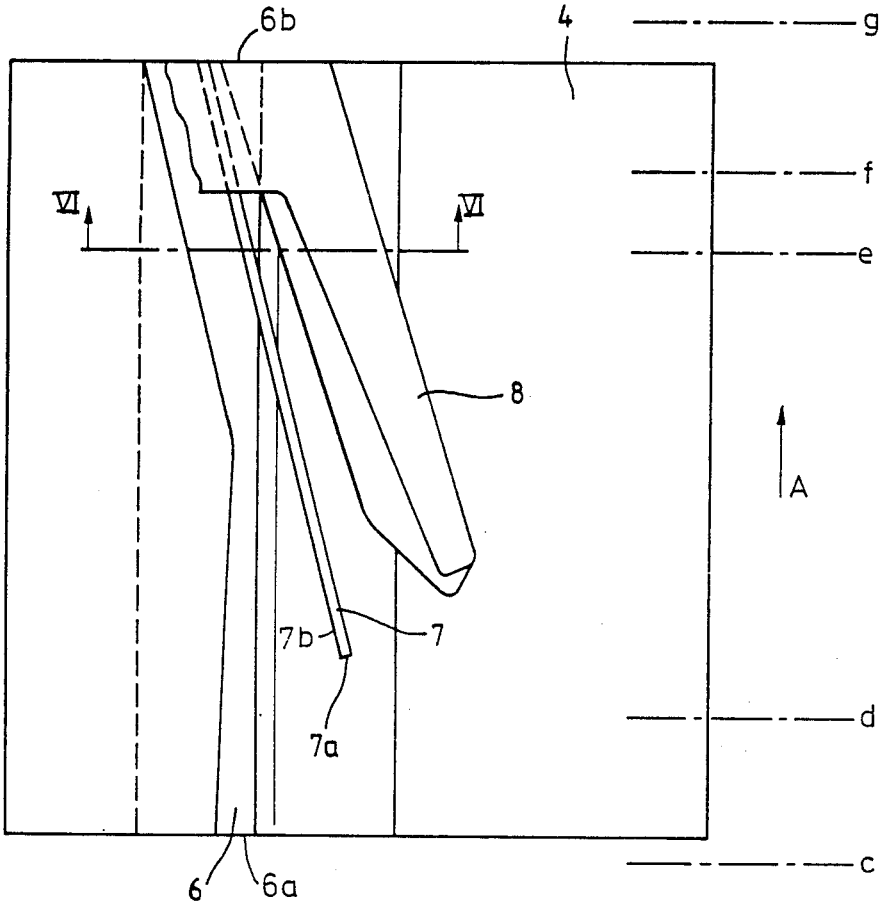
FIG. 5 is a plan view of a unit according to the invention for closing the receptacle of FIGS. 1–4.

FIGS. *7a–7g* illustrate a procedure according to the invention for filling and closing the receptacle of FIGS. 1–4 using the unit of FIGS. 5 and 6; and FIGS. *8a–8e* illustrate another procedure in accordance with the invention for closing the receptacle of FIGS. 1–4 using a further embodiment of the closing unit.

DESCRIPTION OF THE PREFERRED EMBODIMENTS

Figure 1:
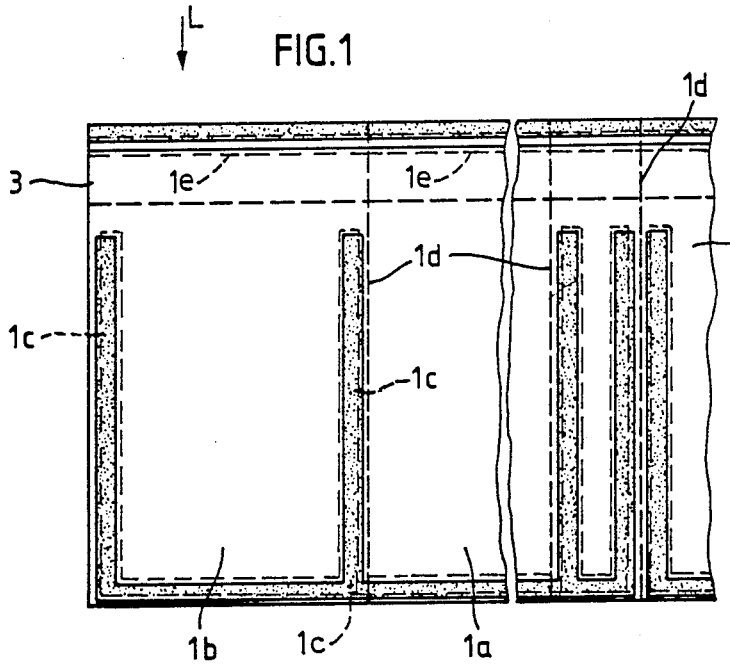
FIG. 1 is a plan view of a receptacle according to the invention.

FIG. 1 illustrates a receptacle for use in photographic processing facilities to package customer orders of developed film strips and/or photographs. Film and/or photographs are loaded into the receptacle in the direction indicated by the arrow L. The film and/or photographs will normally be stacked prior to loading and introduced into the receptacle in the form of stacks.

The receptacle constitutes part of an elongated band of receptacles manufactured according to the endless or continuous method, and the band extends in a direction transverse to the loading direction L. When such a band is placed in a packing carton or box, it is folded in a zigzag-like fashion along the walls of the carton thereby allowing the band to fit in a carton having a length smaller than that of the band.

The receptacle shown in FIG. 1 comprises a base panel 1 which extends over the full width of the receptacle (the width of the receptacle is the vertical dimension in FIG. 1). The receptacle further comprises a cover panel 2 (see FIG. 2) which is juxtaposed with the base panel 1, and the lower edge of the cover panel 2 is essentially in register with the lower edge of the base panel 1.

The base panel 1 and cover panel 2 are connected to one another along strip-shaped junctions 1c which may, for example, be in the form of adhesive strips. The junctions 1c delineate the outlines of two pockets 1a and 1b defined by the base panel 1 and the cover panel 2. Each of the pockets 1a,1b has an openable and closable side 1e (hereinafter "open side" for brevity) for insertion of film and/or photographs therein, and removal of film and/or photographs therefrom. It is assumed here that the pocket 1a is designed to accommodate a stack of photographs while the pocket 1b is designed to accommodate a stack of developed film strips, i.e., a stack of strips each of which consists of a series of developed exposures. The width of the base panel 1 is selected in such a manner that all photographs within the range of sizes contemplated for the receptacle may be properly accommodated in the pocket 1a when inserted in the latter so that a narrow edge of the photograph is the leading edge as considered in the loading direction L. This width may, for instance, be of the order of 20 centimeters. Such a width allows film strips consisting of about four small negatives each to be inserted in the pocket 1b.

Figure 2:
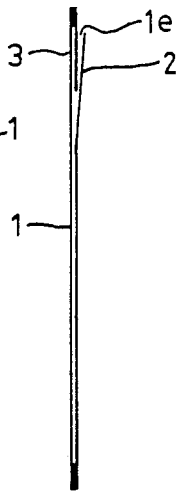
FIG. 2 is a side view of the receptacle of FIG. 1.

As best seen in FIG. 2, the cover panel 2 terminates at the open sides 1e of the pockets 1a,1b and below the base panel 1. The distance between the upper edge of the cover panel 2 and the upper edge of the base panel 1 may be approximately 10 millimeters, for example.

FIG. 1 shows that the receptacle is provided with rows 1d of perforations extending parallel to the loading direction L over the entire width of the receptacle. The rows 1d constitute fold lines and tear lines of which the latter may, for instance, serve to permit separation of the illustrated receptacle from an adjacent receptacle in the band of receptacles.

Referring to FIGS. 3 and 4 in conjunction with FIGS. 1 and 2, it will be observed that the portions of the junctions 1c which extend in parallelism with the loading direction L terminate short of the upper edge of the cover panel 2. For example, these portions of the junctions 1c may end at a distance below the upper edge of the cover panel 2 equal to about one-fifth of the width of the latter. Accordingly, the cover panel 2 has a free marginal portion or auxiliary tab 2a adjacent to the open sides 1e of the pockets 1a,1b.

The base panel 1 likewise has a free marginal portion adjacent to the open sides 1e of the pockets 1a,1b. The free marginal portion of the base panel 1 defines a flap 3 which extends from those ends of the junctions 1c nearest the open sides 1e towards and beyond the latter. The flap 3 is provided with a relatively stiff or bend-resistant restraining tab 3a which is connected with the free end of the flap 3 via a strip-like junction 3b such as, for instance, an adhesive strip, having a width of at least two millimeters, e.g., a width of five millimeters. The stiffness of the flap 3 may be comparable to that of the base panel 1. In the illustrated embodiment, the restraining tab 3a is constituted by a strip of material discrete from the flap 3 and secured thereto by means of the junction 3b. However, it is possible to form the restraining tab 3a by folding over the free end of the flap 3 and providing the junction 3b between the flap 3 and its fold. While the junction 3b is here shown as being an adhesive strip, the junction 3b may be formed in conventional manner using needles or toothed wheels.

The restraining tab 3a extends from the free end of the flap 3 towards the auxiliary tab 2a. The width of the junction 3b is at most equal to one-third of the width of the restraining tab 3a. The flap 3 and the portion of the restraining tab 3a extending from the junction 3b may be displaced towards and away from one another by bending the base panel 1 and/or the restraining tab 3a. The displaceable portion of the restraining tab 3a overlaps the auxiliary tab 2a. The distance of overlap preferably equals at least one-half of the width of the restraining tab 3a.

The auxiliary tab 2a terminates at a distance of at least two millimeters from the junction 3b between the flap 3 and the restraining tab 3a.

In FIG. 4, the auxiliary tab 2a is located above the restraining tab 3a, that is, at least part of the restraining tab 3a is disposed between the auxiliary tab 2a and the flap 3. The position of FIG. 4 corresponds to an open position of the open sides 1e of the pockets 1a,1b, and hence to an open position of the pockets 1a,1b. In the open position of the pockets 1a,1b, the auxiliary tab 2a may be readily lifted away from the restraining tab 3a via mechanical means to allow an appropriate apparatus to insert a stack of photographs in the pocket 1a and a stack of film strips in the pocket 1b. The auxiliary tab 2a may be lifted as taught in the commonly-owned U.S. Pat. No. 4,508,224, and the disclosure of this patent is incorporated herein by reference.

The open sides 1e of the pockets 1a,1b, and thus the pockets 1a,1b, further have a closed position. In the closed position, the restraining tab 3a is situated above the auxiliary tab 2a, that is, at least part of the auxiliary tab 2a is disposed between the restraining tab 3a and the flap 3. The restraining tab 3a then functions to close the pockets 1a,1b in such a manner that the film and/or photographs can be removed at will but cannot accidentally fall out. The restraining tab 3a closes the pockets 1a,1b reversibly in that the latter can be opened to remove the film and/or photographs for inspection and then closed once more subsequent to replacement of the film and/or photographs in the pockets 1a,1b.

FIGS. 5 and 6 illustrate a unit which constitutes part of an arrangement for manipulating the receptacle and functions to close the pockets 1a,1b. The arrangement may further include a non-illustrated loading or filling apparatus in which a stack of photographs is inserted in the pocket 1a and a stack of film strips is inserted in the pocket 1b. The closing unit, which is located downstream of the loading apparatus, comprises a sheet-like member or sheet 20 having a generally horizontal supporting section 4 defining a surface 4b which is designed to support the filled pockets 1a,1b during the closing operation. The sheet 20 further includes an angular section 5 which extends from an edge 4a of the supporting section 4. The angular section 5 has a pair of legs 5a and 5b which define an angle of approximately 120°, and each of the legs 5a,5b is inclined at an angle of about 30° to the horizontal. An L-shaped section 21 extends from the edge 5c of the angular section 5 which is remote from the supporting section 4. The L-shaped section has a short leg 21a which is generally perpendicular to the leg 5b of the angular section 5, and a long leg 21b which is generally perpendicular to the short leg 21a. The sheet 20 has an additional section extending from the edge of the L-shaped section 21 which is remote from the angular section 5, and this additional section bends back to the horizontal.

The leg 5b of the angular section 5, together with the legs 21a,21b of the L-shaped section 21, defines a guiding slot 6 which is inclined to the horizontal. The guiding slot 6 defines an angle of at least 30° with the plane of the supporting surface 4*b*, and advantageously defines an angle of 45° with such plane. The guiding slot 6 is designed to receive the flap 3 and restraining tab 3*a*, including those portions of the flap 3 and restraining tab 3*a* which are joined to one another via the junction 3*b*. To this end, the width and depth of the guiding slot 6 are selected in such a manner that the part of the receptacle comprising the flap 3, the restraining tab 3*a* and the junction 3*b* can be accommodated in the guiding slot 6 with clearance.

The guiding slot 6 has an inlet end 6*a* and an outlet end 6*b*, and the flap 3 and restraining tab 3*a* are introduced into the guiding slot 6 laterally, that is, from the side. Thus, the flap 3 and restraining tab 3*a* are inserted into the guiding slot 6 via the inlet end 6*a*. The flap 3 and restraining tab 3*a* are then conveyed along the guiding slot 6 towards, and leave the guiding slot 6 through, the outlet end 6*b*. The guiding slot 6 functions to guide the flap 3 and restraining tab 3*a*, and hence the receptacle, for movement in a predetermined direction indicated by the arrow A.

In order to facilitate introduction of the flap 3 and restraining tab 3*a* into the guiding slot 6, the inlet end 6*a* is widened and has a funnel-like configuration.

While the guiding slot 6 is illustrated as being defined by the sheet 20, the guiding slot 6 may just as well be machined into a solid body of synthetic resin or metal.

The closing unit further comprises a tab displacing member or wedge-like separator 7 which is disposed at a level above, and extends at an angle to, the guiding slot 6. The tab displacing member 7 has a tip 7*a* which is located approximately over the bend in the angular section 5, and an upper edge or guiding portion 7*b* which extends from the tip 7*a* towards the opposite end of the tab displacing member 7. The upper edge 7*b* is inclined to the horizontal in such a manner that it progressively rises in a direction away from the tip 7*a*. The upper edge 7*b* is designed to engage and guide the displaceable portion of the restraining tab 3*a* as the flap 3 and restraining tab 3*a* are conveyed along the guiding slot 6. Due to the fact that the tab displacing member 7 extends at an angle to the guiding slot 6, the upper edge 7*b* progressively forces the restraining tab 3*a* upwards and backwards away from the flap 3 as the flap 3 and restraining tab 3*a* move through the guiding slot 6. As a result, the restraining tab 3*a* defines a continuously increasing angle with the plane of the supporting surface 4*b*. The tab displacing member 7 is arranged in such a manner that the restraining tab 3*a* ultimately is approximately normal to the plane of the supporting surface 4*b*.

A tab urging member or guiding and closing member 8 is arranged on that side of the tab displacing member 7 nearest the supporting surface 4*b* and extends approximately parallel to the tab displacing member 7. The tab urging member 8 has a lower edge or guiding section which is spaced from the plane of the supporting surface 4*b* by a relatively great distance at that end of the tab urging member 8 which is closest to the inlet end 6*a* of the guiding slot 6. The distance between the lower edge of the tab urging member 8 and the plane of the supporting surface 4*b* decreases in a direction from the inlet end 6*a* to the outlet end 6*b* of the guiding slot 6. The lower edge of the tab urging member 8 functions to guide and urge the auxiliary tab 2*a* towards the base panel 1 as the flap 3 and the restraining tab 3*a* advance along the guiding slot 6 in the direction A.

The tab displacing member 7 and tab urging member 8 make an angle of about 15° with the direction A, and the inclination of the tab displacing member 7 and tab urging member 8 with reference to the direction A is such that the members 7,8 angle away from the supporting surface 4*b* in the direction A. The tab displacing member 7 is so arranged that the restraining tab 3*a* becomes disengaged therefrom by the time the restraining tab 3*a* reaches the outlet end 6*b* of the guiding slot 6. Similarly, the tab urging member 8 is arranged so that the auxiliary tab 2*a* moves out of contact with the member 8 no later than arriving at the outlet end 6*b*.

FIGS. 7*a*–7*g* illustrate a method of loading the receptacle and closing the latter by means of the closing unit of FIGS. 5 and 6.

Figure 7A:
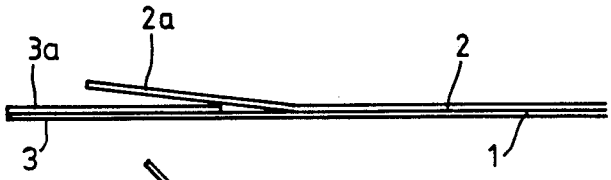
Figure 7B:
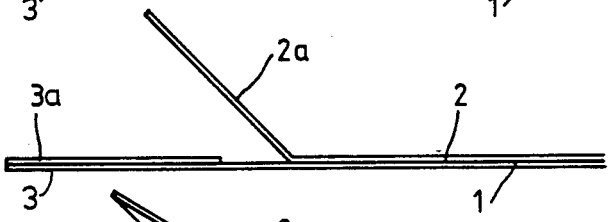

The position of the receptacle in FIGS. 7*a* and 7*b* corresponds to the position a,b of FIG. 6. In this position, the receptacle is in a loading apparatus which is located upstream of the closing unit as considered in the direction of advance A of the receptacle and functions to insert a stack of photographs in the pocket 1*a* and a stack of developed film strips in the pocket 1*b*. One of these stacks is shown and is identified by the reference numeral 9.

In the loading apparatus, the base panel 1 is stretched out on a support corresponding to the supporting section 4 of the closing unit. FIG. 7*a* shows the receptacle before the loading operation has begun, and the auxiliary tab 2*a* is located above and immediately adjacent to the restraining tab 3*a*. Since the restraining tab 3*a* is disposed between the auxiliary tab 2*a* and the base panel 1, the pockets 1*a*,1*b* are open.

In FIG. 7*b*, the auxiliary tab 2*a* is lifted away from the restraining tab 3*a* and the flap 3 via conventional lifting means. As a result, the auxiliary tab 2*a* and restraining tab 3*a* define a funnel-like inlet to the pockets 1*a*,1*b*. This allows the stacks 9 of photographs and film strips to be automatically inserted in the respective pockets 1*a*,1*b*.

Figure 7C:
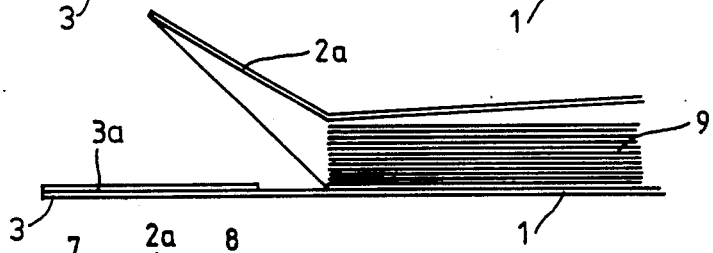

FIG. 7*c* corresponds to the position c of FIG. 6. In this position, the stacks 9 have been introduced into the pockets 1*a*,1*b*.

From the position c, the loaded receptacle is conveyed into the closing unit of FIGS. 5 and 6. During transfer of the receptacle from the loading apparatus to the closing unit, the auxiliary tab 2*a* remains in the elevated position in which it is upwardly inclined with respect to the horizontal. The restraining tab 3*a*, on the other hand, lies flat against the flap 3 of the base panel 1.

Figure 7D:
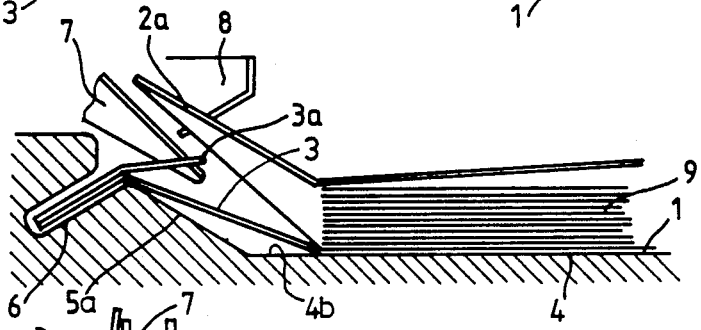

FIG. 7*d* corresponds to the position d of FIG. 6 and is a sectional view of the closing unit at this position as seen in the direction A. As the receptacle is transported from the position c to the position d, at least the sandwich-like part of the receptacle consisting of the junction 3*b* and the contiguous portions of the flap 3 and restraining tab 3*a* enters the guiding slot 6 laterally via the inlet opening 6*a*. The pockets 1*a*,1*b* containing the stacks 9 move onto the supporting section 4 as the receptacle travels into the closing unit from the position c. Due to the angular relationship between the guiding slot 6 and the plane of the supporting surface 4*b* of the supporting section 4, the flap 3 is bent at two locations upon entry of the receptacle into the closing unit. One such location is in the region of those ends of the junctions 1*c* nearest the open sides 1*e* of the pockets 1*a*,1*b*. The second location lies between the junction 3*b* and the free end of the restraining tab 3*a*, preferably nearer the junction 3*b* than the free end of the tab 3*a*. The portion of the flap 3 between the bends is only partially in contact with the supporting surface 4*b* and the leg 5*a* of the angular section 5.

Bending of the flap 3 as the receptacle is conveyed into the closing unit occurs by virtue of the weight of the stacks 9 in the pockets 1*a*,1*b*. Such bending results in relative displacement of the flap 3 and restraining tab 3*a* away from one another so that the tab 3*a* is upwardly inclined with respect to the horizontal. As the receptacle moves into the closing unit, an operator presses upon the receptacle thereby urging the portion of the flap 3 between the bends towards the supporting surface 4*b* and the leg 5*a* of the angular section 5. Consequently, the flap 3 is bent to a greater extent which, in turn, causes additional displacement of the flap 3 and restraining tab 3*a* away from one another. Due to its stiffness, the upwardly inclined restraining tab 3*a* is stretched out nearly straight upon being displaced relative to the flap 3 under the action of the weight of the stacks 9 and the pressure of the operator.

As the receptacle is advanced from the position d of FIG. 6, the restraining tab 3*a* is intercepted by the tip 7*a* of the tab displacing member 7. Upon continued advancement of the receptacle, the restraining tab 3*a* is now progressively forced upwards away from the flap 3 by the upper edge 7*b* of the tab displacing member 7. The restraining tab 3*a* is displaced upwards because the receptacle travels in the direction A whereas the tab displacing member 7 which engages the restraining tab 3*a* is inclined with respect to the direction A. The angle between the restraining tab 3*a* and the plane of the supporting surface 4*b* increases continuously during upward displacement of the restraining tab 3*a*. Preferably, the restraining tab 3*a* is upwardly displaced until it is normal or approximately normal to the plane of the supporting surface 4*b*. However, this is not absolutely necessary. It is merely necessary to displace the restraining tab 3*a* sufficiently to permit movement of the auxiliary tab 2*a* by the restraining tab 3*a* towards the flap 3.

The auxiliary tab 2*a* is engaged by the lower edge of the tab urging member 8 as the receptacle is advanced from the position d of FIG. 6. Since the distance between the lower edge of the tab urging member 8 and the plane of the supporting surface 4*b* decreases in the direction of advance A of the receptacle, the auxiliary tab 2*a* is progressively moved from its upwardly inclined position towards the flap 3 during advancement of the receptacle from the position d.

Figure 7E:
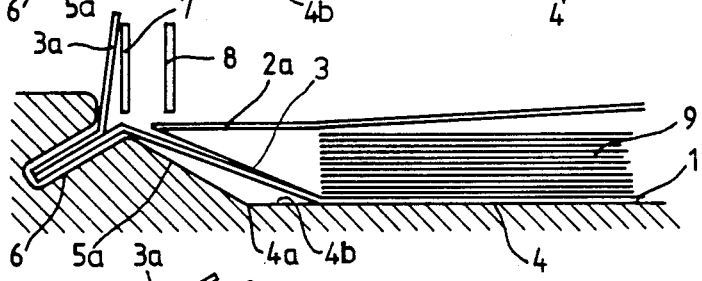

FIG. 7*e* corresponds to the position e of FIG. 6 and is a sectional view of the closing unit at this position as seen in the direction A. In the position e, the restraining tab 3*a* is approximately perpendicular to the plane of the supporting surface 4*b* as shown. FIG. 7*e* also illustrates that the auxiliary tab 2*a*, which was upwardly inclined and spaced from the flap 3 by a considerable distance upon entering the closing unit, has been moved by the tab urging member 8 to a position closely adjacent to the flap 3.

Figure 7F:
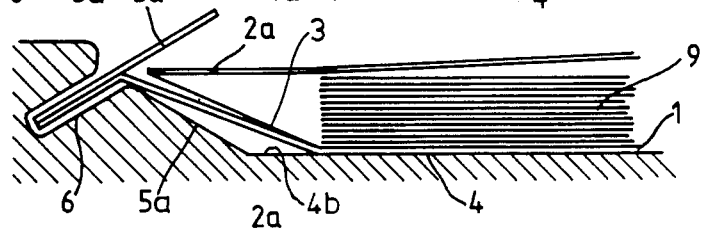

FIG. 7*f* corresponds to the position f of FIG. 6 and is a sectional view of the closing unit at this position as seen in the direction A. Between the positions e and f, the restraining tab 3*a* becomes disengaged from the tab displacing member 7 while the auxiliary tab 2*a* becomes disengaged from the tab urging member 8. Disengagement of the restraining tab 3*a* from the tab displacing member 7 and the auxiliary tab 2*a* from the tab urging member 8 occurs at least in part because the members 7,8 progressively angle away from the supporting surface 4*b* in the direction of advance A of the receptacle. When the restraining tab 3*a* and auxiliary tab 2*a* become free of the respective members 7 and 8, the restraining tab 3*a* straightens itself by shifting towards the flap 3 and the auxiliary tab 2*a*. Since the auxiliary tab 2*a* remains in a position adjacent to the flap 3, the restraining tab 3*a* is located above the auxiliary tab 2*a* upon straightening as shown in FIG. 7*f*, i.e., the auxiliary tab 2*a* is disposed between the restraining tab 3*a* and the flap 3.

When the flap 3 and the restraining tab 3*a* leave the guiding slot 6, the flap 3 straightens itself. This causes the flap 3 and restraining tab 3*a* to move towards one another, and such movement is accompanied by further shifting of the restraining tab 3*a* towards the auxiliary tab 2*a*. The restraining tab 3*a* now comes to rest against the auxiliary tab 2*a* thereby closing the pockets 1*a*,1*b*.

Figure 7G:
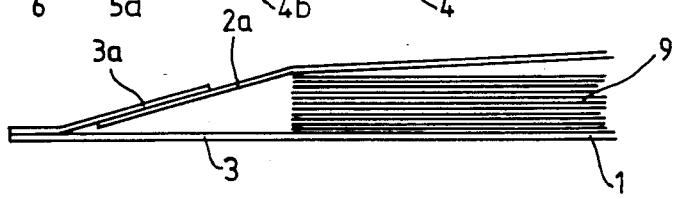

FIG. 7*g* corresponds to the position g of FIG. 6. In this position, the flap 3 and restraining tab 3*a* have left the guiding slot 6 so that the pockets 1*a*,1*b* are closed. FIG. 7*g* shows that the auxiliary tab 2*a* is disposed between the restraining tab 3*a* and the flap 3 in the closed position of the pockets 1*a*,1*b*, and that the restraining tab 3*a* bears against the auxiliary tab 2*a*. The restraining tab 3*a* holds the auxiliary tab 2*a* adjacent to the flap 3 in the closed position of the pockets 1*a*,1*b* and may even urge the auxiliary tab 2*a* into contact with the flap 3.

The base panel 1 as well as the restraining tab 3*a* may be relatively stiff, that is, may offer relatively good resistance to bending. Relatively great stiffness of the base panel 1 and restraining tab 3*a* allows the closure for the pockets 1*a*,1*b* to be so effective that, even if the receptacle is shaken while the open sides 1*e* of the pockets 1*a*,1*b* face downards, the stacks 9 are unable to bend the restraining tab 3*a* to such an extent that the auxiliary tab 2*a* can move by the restraining tab 3*a*. On the other hand, the receptacle may be readily opened by manually pulling back the restraining tab 3*a* and/or the auxiliary tab 2*a*. Moreover, the receptacle may again be closed by hand after removal of the photographs and/or film strips from the pockets 1*a*,1*b* for an initial observation and reinsertion of the photographs and/or film strips in the pockets 1*a*,1*b*.

The arrangement including the loading apparatus and closing unit may be provided with conveying means such as driven rollers for advancing the receptacle in the direction A.

FIGS. 8*a*–8*e* illustrate another embodiment of the closing unit as well as a further procedure for closing the receptacle using the closing unit of FIGS. 8*a*–8*e*.

The closing unit of FIGS. 8*a*–8*e* comprises a supporting section 10 defining a surface 10*a* which functions as an abutment surface for the loaded pockets 1*a*,1*b*. A slot 11 is disposed adjacent to the abutment surface 10*a*. The slot 11 is designed to receive and hold at least part of the sandwich-like section of the receptacle consisting of the junction 3*b* and the contiguous portions of the flap 3 and restraining tab 3*a*. The breadth of the slot 11 is accordingly selected in such a manner that the sandwich-like section of the receptacle can be readily pushed into the slot 11. The depth of the slot 11 is preferably equal to at least the width of the junction 3*b* between the flap 3 and the restraining tab 3*a*.

The slot 11 is bounded by a pair of walls 12*a* and 12*b* which are generally normal to the plane of the abutment surface 10*a*. Hence, the slot 11 and the abutment surface 10*a* define an angle of approximately 90°. It is possible, however, for the slot 11 and the abutment surface 10*a* to define an angle greater than 90°.

The boundary surface 12*b* of the slot 11 which is on the side of the latter remote from the abutment surface 10*a* has an extension 12*c*. The extension 12*c*, which is preferably perpendicular to the plane of the abutment surface 10*a*, constitutes a deflecting surface or element.

Figure 8A:
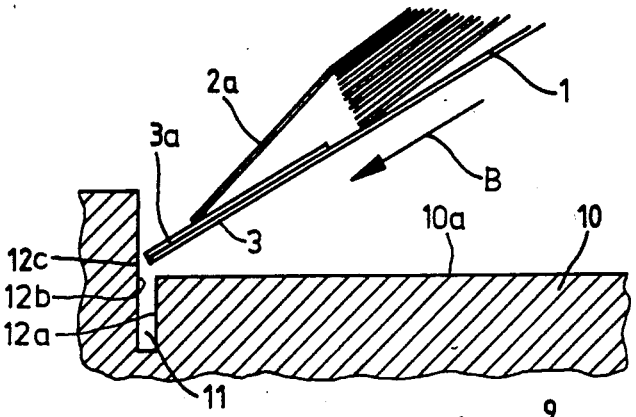

To close the receptacle, the latter is conveyed towards the deflecting surface 12*c* in the direction indicated by the arrow B in FIG. 8*a*. The receptacle is so oriented that the flap 3 and restraining tab 3*a* are located at the leading end of the receptacle. The direction of movement B is parallel but counter to the loading direction L of the receptacle (see FIG. 1) and inclined with reference to the abutment surface 10*a*.

Figure 8B:
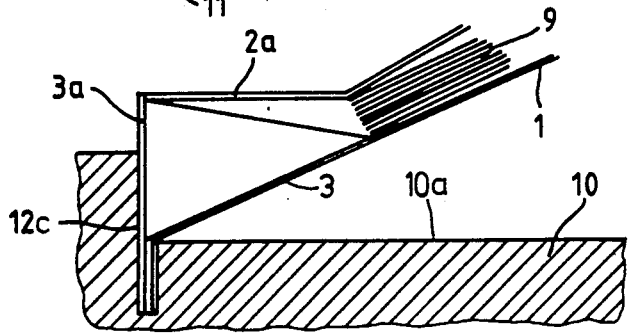

When the leading end of the receptacle is pushed against the deflecting surface 12*c*, the flap 3 bends sharply and the sandwich-like section of the receptacle consisting of the junction 3*b* and the contiguous portions of the flap 3 and restraining tab 3*a* enters the slot 11. This is illustrated in FIG. 8*b*. Since the restraining tab 3*a* is relatively stiff, it does not follow the bending motion of the flap 3 and remains essentially straight. Accordingly, the flap 3 and restraining tab 3*a* are displaced away from one another. The restraining tab 3*a* projects virtually straight up and is substantially normal to the plane of the abutment surface 10*a*.

Figure 8C:
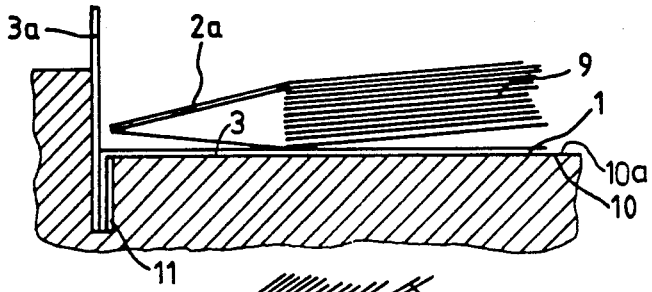

The relative displacement of the flap 3 and restraining tab 3*a* during insertion of the sandwich-like section of the receptacle into the slot 11 is sufficiently great to permit movement of the auxiliary tab 2*a* by the restraining tab 3*a*. The auxiliary tab 2*a* slides past the free end of the restraining tab 3*a* as shown in FIG. 8*b* and then snaps downwards as illustrated in FIG. 8*c*, that is, the auxiliary tab 2*a* moves by the restraining tab 3*a* and towards the flap 3. Movement of the auxiliary tab 2*a* towards the flap 3 is enhanced by further bending the flap 3 until the pockets 1*a*,1*b* come into abutment with the abutment surface 10*a* as shown in FIG. 8*c*. The flap 3 is now bent approximately 90°. If the slot 11 and the abutment surface 10*a* define an angle in excess of 90°, the flap 3 will be bent through an angle greater than 90° when the pockets 1*a*,1*b* come into abutment with the abutment surface 10*a*.

Figure 8D:
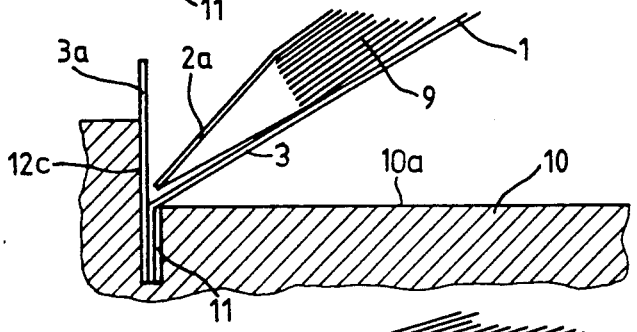

Once the auxiliary tab 2*a* has moved to a position adjacent to the flap 3 as illustrated in FIG. 8*c*, the pockets 1*a*,1*b* are moved away from the abutment surface 10*a* until the receptacle is inclined at about the same angle as during introduction of the sandwich-like section of the receptacle into the slot 11, i.e., until the receptacle has about the same inclination as in FIG. 8*a*. This is shown in FIG. 8*d*. The sandwich-like section may now be readily pulled up out of the slot 11.

Figure 8E:
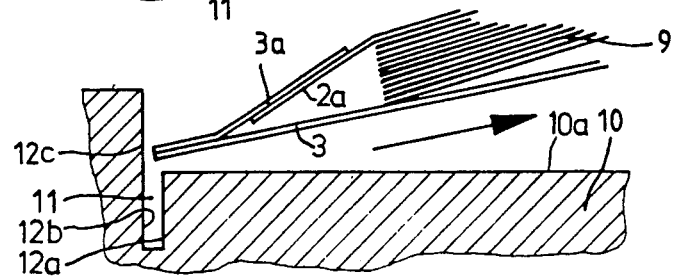

Upon withdrawal of the sandwich-like section from the slot 11, the flap 3 straightens itself to at least some degree as illustrated in FIG. 8*e*. Consequently, the flap 3 and the restraining tab 3*a* move towards one another, and this movement is accompanied by a shift of the restraining tab 3*a* towards the auxiliary tab 2*a*. The restraining tab 3*a* comes to rest against the auxiliary tab 2*a* thereby closing the pockets 1*a*,1*b*. As before, the restraining tab 3*a* holds the auxiliary tab 2*a* adjacent to, and may even hold the auxiliary tab 2*a* in contact with, the flap 3.

The closing unit and method of FIGS. 8*a*–8*e* require an operator to perform a few more operations than with the closing unit and method of FIGS. 5, 6 and 7*a*–7*g*. These additional operations include inserting the sandwich-like section of the receptacle into the slot 11; abutting the pockets 1*a*,1*b* with the abutment surface 10*a*; and lifting the receptacle from the closing unit.

Pushing of the sandwich-like section of the receptacle into the slot 11 may be facilitated by making the surface 12*b* and/or 12*c* concave.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An arrangement for manipulating a receptacle for developed film and/or photographs, the receptacle including a pair of panels defining at least one pocket having an openable and closable side, and one of the panels having a flap extending beyond the openable and closable side, the other of the panels terminating at, and including a first tab adjacent to, the openable and closable side, and the flap being provided with a second tab which normally overlaps the first tab, the first tab having a first position in which the openable and closable side is open for insertion of developed film and/or photographs in, and removal of developed film and/or photographs from, the pocket, and the first tab having a second position in which the openable and closable side is closed, at least part of the second tab being disposed between the first tab and the one panel in the first position, and at least part of the first tab being disposed between the second tab and the one panel in the second position, said arrangement including a unit for closing the openable and closable side subsequent to insertion of developed film and/or photographs in the pocket, and said unit comprising first means defining a slot designed to receive the flap and guide the same for movement in a predetermined direction, said first means further defining a surface designed to support the pocket as the flap is conveyed along said slot, and said slot and said surface defining an angle of at least 30°; and second means for displacing the second tab so as to permit movement of the first tab by the second tab, said second means being arranged to displace the second tab in such a manner that the second tab and said surface define an increasing angle as the flap is conveyed along said slot.

2. The arrangement of claim 1, wherein said unit comprises third means for urging the first tab towards the one panel as the flap is conveyed along said slot.

3. The arrangement of claim 2, wherein said third means is disposed on a side of said second means facing said surface.

4. The arrangement of claim 1, wherein said slot and said surface define an angle of substantially 45°.

5. The arrangement of claim 1, said second means including a tab displacing member having a guiding portion arranged to guide the second tab as the flap is conveyed along said slot; and wherein said guiding portion is inclined with reference to said predetermined direction such that said guiding portion angles away from said surface in said predetermined direction.

6. The arrangement of claim 1, wherein said second means is arranged to displace the second tab to a position such that the second tab and said surface define an angle in the range of 90°.

7. The arrangement of claim 1, wherein said second means is arranged to displace the second tab in such a manner that the second tab and said surface define a progressively increasing angle as the flap is conveyed along said slot.

8. The arrangement of claim 1, wherein said second means is fixed.

9. An arrangement for maniplulating a receptacle for developed film and/or photographs, the receptacle including a pair of panels defining at least one pocket having an openable and closable side, and one of the panels having a flap extending beyond the openable and closable side, the other of the panels terminating at, and including a first tab adjacent to, the openable and closable side, and the flap being provided with a second tab which normally overlaps the first tab. the first tab having first position in which the openable and closable side is open for insertion of developed film and/or photographs in, and removal of developed film and/or photographs from, the pocket, and the first tab having a second position in which the openable and closable side is closed, at least part of the second tab being disposed between the first tab and the one panel in the first position, and at least part of the first tab being disposed between the second tab and the one panel in the second position, said arrangement including a unit for closing the openable and closable side subsequent to insertion of developed film and/or photographs in the pocket, and said unit comprising means defining a slot designed to confine at least part of the flap, said slot being bounded by a wall, and said means further defining a deflecting element constituting an extension of said wall beyond said slot and arranged to cause bending of the one panel upon introduction of the flap into said slot, said means additionally defining a surface arranged to be abutted by the pocket when the flap is confined in said slot and the one panel is bent.

10. The arrangement of claim 9 wherein, said wall is at least approximately perpendicular to said surface.

11. The arrangement of claim 9, wherein said surface is arranged to be abutted by the pocket when the flap is confined in said slot and the one panel is bent at least 90°.

12. The arrangment of claim 9, wherein said slot and said surface define an angle of at least 90°.

13. An arrangement for manipulating a receptacle for developed film and/or photographs, the receptacle including a pair of panels defining at least one pocket having an openable and closable side, and one of the panels having a flap extending beyond the openable and closable side, the other of the panels terminating at, and including a first tab adjacent to, the openable and closable side, and the flap being provided with a second tab which normally overlaps the first tab, the first tab having a first position in which the openable and closable side is open for insertion of developed film and/or photographs in, and removal of developed film and/or photographs from, the pocket, and the first tab having a second position in which the openable and closable side is closed, at least part of the second tab being disposed between the first tab and the one panel in the first position, and at least part of the first tab being disposed between the second tab and the one panel in the second position, said arrangement including a unit for closing the openable and closable side subsequent to insertion of developed film and/or photographs in the pocket, and said unit comprising first means defining a slot designed to receive the flap and guide the same for movement in a predetermined direction, said first means further defining a surface designed to support the pocket as the flap is conveyed along said slot, and said slot and said surface defining an angle of at least 30°; second means for displacing the second tab so at to permit movement of the first tab by the second tab, said second means being arranged to displace the second tab in such a manner that the second tab and said surface define an increasing angle as the flap is conveyed along said slot; and third means for urging the first tab towards the one panel as the flap is conveyed along said slot, said third means including a tab urging member aranged to urge the first tab towards the one panel as the flap is conveyed along said slot, and said tab urging member being inclined with reference to said predetermined direction such that said tab urging member angles away from said surface in said predetermined direction.

14. The arrangement of claim 13, said second means including a tab displacing member arranged to guide the second tab as the flap is conveyed along said slot; and wherein said tab displacing member is inclined with reference to said predetermined direction such that said tab displacing member angles away from said surface in said predetermined direction.

15. The arrangement of claim 14, wherein each of said members defines an angle of substantially 15° with said predetermined direction.

16. An arrangement for manipulating a receptacle for developed film and/or photographs, the receptacle including a pair of panels defining at least one pocket having an openable and closable side, and one of the panels having a flap extending beyond the openable and closable side, the other of the panels terminating at, and including a first tab adjacent to, the openable and closable side, and the flap being provided with a second tab which normally overlaps the first tab, the first tab having a first position in which the openable and closable side is open for insertion of developed film and/or photographs in, and removal of developed film and/or photographs from, the pocket, and the first tab having a second position in which the openable and closable side is closed, at least part of the second tab being disposed between the first tab and the one panel in the first position, and at least part of the first tab being disposed between the second tab and the one panel in the second position, said arrangement including a unit for closing the openable and closable side subsequent to insertion of developed film and/or photographs in the pocket, and said unit comprising first means defining a slot designed to receive the flap and guide the same for movement in a predetermined direction, said first means further defining a surface designed to support the pocket as the flap is conveyed along said slot, and said slot and said surface defining an angle of at least 30°; second means for displacing the second tab so as to permit movement of the first tab by the second tab, said second means being arranged to displace the second tab in such a manner that the second tab and said surface define an increasing angle as the flap is conveyed along said slot; and third means for urging the first tab towards the one panel as the flap is conveyed along said slot, said third means being arranged to progressively urge the first tab towards the one panel as the flap is conveyed along said slot.

17. An arrangement for manipulating a receptacle for developed film and/or photographs, the receptacle including a pair of panels defining at least one pocket having an openable and closable side, and one of the panels having a flap extending beyond the openable and closable side, the other of the panels terminating at, and including a first tab adjacent to, the openable and closable side, and the flap being provided with a second tab which normally overlaps the first tab, the first tab having a first position in which the openable and closable side is open for insertion of developed film and/or photographs in, and removal of developed film and/or photographs from, the pocket, and the first tab having a second position in which the openable and closable side is closed, at least part of the second tab being disposed between the first tab and the one panel in the first position, and at least part of the first tab being disposed between the second tab and the one panel in the second position, said arrangement including a unit for closing the openable and closable side subsequent to insertion of developed film and/or photographs in the pocket, and said unit comprising first means defining a slot designed to receive the flap and guide the same for movement in a predetermined direction, said first means further defining a surface which is located in a predetermined plane and is designed to support the pocket as the flap is conveyed along said slot, and said slot and said surface defining an angle of at least 30°; second means for displacing the second tab so as to permit movement of the first tab by the second tab, said second means being arranged to displace the second tab in such a manner that the second tab and said surface define an increasing angle as the flap is conveyed along said slot; and third means for urging the first tab towards the one panel as the flap is conveyed along said slot, said third means including a tab urging member having a guiding section arranged to guide the first tab towards the one panel as the flap is conveyed along said slot, and said guiding section being designed such that the distance between said plane and said guiding section decreases in said predetermined direction.

* * * * *